US011332693B2

(12) United States Patent
Berbez

(10) Patent No.: US 11,332,693 B2
(45) Date of Patent: May 17, 2022

(54) ORGANIC COMPOUNDS

(71) Applicant: GIVAUDAN SA, Vernier (CH)

(72) Inventor: Chloe Berbez, Agenteuil (FR)

(73) Assignee: GIVAUDAN SA, Vernier (CH)

( * ) Notice: Subject to any disclaimer, the term of this patent is extended or adjusted under 35 U.S.C. 154(b) by 0 days.

(21) Appl. No.: 15/779,797

(22) PCT Filed: Dec. 9, 2016

(86) PCT No.: PCT/EP2016/080418
§ 371 (c)(1),
(2) Date: May 29, 2018

(87) PCT Pub. No.: WO2017/097972
PCT Pub. Date: Jun. 15, 2017

(65) Prior Publication Data

US 2018/0371359 A1 Dec. 27, 2018

(30) Foreign Application Priority Data

Dec. 11, 2015 (GB) ..... 1521861

(51) Int. Cl.
*C11B 9/00* (2006.01)

(52) U.S. Cl.
CPC ..... *C11B 9/0034* (2013.01); *C11B 9/008* (2013.01); *C11B 9/0015* (2013.01); *C11B 9/0019* (2013.01); *C11B 9/0038* (2013.01); *C11B 9/0042* (2013.01); *C11B 9/0049* (2013.01); *C11B 9/0053* (2013.01); *C11B 9/0076* (2013.01); *C11B 9/0088* (2013.01)

(58) Field of Classification Search
None
See application file for complete search history.

(56) References Cited

U.S. PATENT DOCUMENTS

| | | | | |
|---|---|---|---|---|
| 6,054,426 | A * | 4/2000 | Schulte-Elte | C07C 31/1355 512/22 |
| 2008/0248990 | A1 | 10/2008 | Bajgrowicz et al. | |
| 2013/0065807 | A1 | 3/2013 | Eh et al. | |
| 2016/0089462 | A1* | 3/2016 | Frankenbach | A61Q 13/00 424/76.8 |
| 2017/0114299 | A1* | 4/2017 | Schatkowski | C11B 9/0076 |

FOREIGN PATENT DOCUMENTS

| | | | |
|---|---|---|---|
| EP | 1961725 | A1 | 8/2008 |
| EP | 2947078 | A1 | 11/2015 |
| JP | 2009507862 | A | 2/2009 |
| JP | 2015203100 | A | 11/2015 |
| WO | 2005044206 | A1 | 5/2005 |
| WO | 2007060048 | A1 | 5/2007 |

OTHER PUBLICATIONS

International Search Report and Written Opinion of the International Searching Authority for corresponding application PCT/EP2016/080418 dated Jan. 31, 2017.

Anonymous, "Two news substances of very high concern (SVHC's) added to the Candidate List", Annex to press release, ECHA/PR/15/09, Jun. 15, 2015, pp. 1-2, Helsinki, Finland, retrieved from the Internet: URL:https://echa.europa.eu/documents/10162/22699796/PR_CL_June2015.pdf/c870527f-f54d-447c-8151-a0d87b45693f on Jan. 20, 2017.

* cited by examiner

*Primary Examiner* — Arrie L Reuther
(74) *Attorney, Agent, or Firm* — Norris McLaughlin PA

(57) ABSTRACT

A perfume composition is described which is a suitable replacement in perfumery applications for the compound 2-(2,4-dimethylcyclohex-3-en-1-yl)-5-methyl-5-(1-methylpropyl)-1,3-dioxane.

10 Claims, No Drawings

ORGANIC COMPOUNDS

This is an application filed under 35 USC 371 based on PCT/EP2016/080418, filed 9 Dec. 2016, which in turn is based on GB 1521861.3 filed 11 Dec. 2015. The present application claims the full priority benefit of these prior applications and herein incorporates by reference the full disclosures of these prior applications.

FIELD OF THE INVENTION

The present invention relates to the field of perfumery. More particularly, it concerns a perfume composition, which is useful as a replacement for KARANAL® in both technical and fine perfumery applications.

BACKGROUND OF THE INVENTION 2-(2,4-dimethylcyclohex-3-en-1-yl)-5-methyl-5-(1-methylpropyl)-1,3-dioxane, commercially available under the trade name KARANAL® is a perfume ingredient that is valued for the dry, radiant, woody ambery notes that it brings to fragrance formulations and articles. However, recently, a perception has grown concerning environmental issues related to bioaccumulation and biodegradability, which has led KARANAL® to be classified as a Substance of Very High Concern (SVHC) by ECHA. Its regulatory status in Europe is currently under review, and if confirmed as a SVHC, specific authorization will be necessary before it can be used.

In the event that its SVHC status is confirmed, one can expect that perfumers will be compelled to rely less on KARANAL®, or they may eliminate it from their palettes altogether. In anticipation of such regulatory restrictions, there is a need to provide a substitute for KARANAL® in the perfumers' palette.

KARANAL® can be broadly categorized as a perfume ingredient exhibiting a warm, ambery, woody odour. However, among the ambery, woody class of perfume ingredients KARANAL® has quite unique odour qualities. More specifically, it has an unusual characteristic dry, mineral effect, which has also been expressed as a sharp, radiant, burning effect.

Moreover, from a technical perspective, it is a very powerful and performant perfume ingredient. For example, when tested in technical perfumery in products as diverse as laundry detergent compositions and hair care products, such as shampoos, it's odour has been described as characteristically prominent during all stages of application, from the first impactful impression it creates when smelled neat in a container; through its blooming effect when diluted in water; and thereafter its long-lasting effect after application onto a substrate (e.g. hair or fabrics) both during the wet stage when the substrate is drying, and thereafter once the substrate is dry.

Among the many woody, ambery perfume ingredients available to the perfumer, the complex character of KARANAL®, as well as its excellent technical performance, enables perfumers to create truly unique and differentiating fragrances in both fine perfumery and technical perfumery. However, owing to this complexity it is regarded as a difficult molecule with which to formulate. Related to this, and of concern in the context of the present invention, this also implies that the task of finding a replacement or substitute for it in the perfumers' palette would be an arduous task. Indeed, through extensive investigation, the applicant found that the existing ambery, woody palette of ingredients offers no single ingredient solution to the problem of KARANAL® replacement, nor do combinations of ingredients from the ambery, woody palette offer a suitable surrogate for KARANAL®. Furthermore, the applicant is not aware of any prior art solution to this problem, and the surrogate for KARANAL® in terms of both hedonics and technical performance has proven to be elusive.

SUMMARY OF THE INVENTION

The present disclosure remedies the deficiency in the prior art by providing in a first aspect a woody, ambery perfume composition defined herein below, which is free, or substantially free, of KARANAL® but which is reminiscent of the odour and performance of KARANAL® nevertheless.

The disclosure also relates in another of its aspects to a fragrance formulation containing said woody, ambery perfume composition.

The disclosure relates in yet another aspect to a perfumed article, such as a fine perfume, a fabric care product, home care product, personal care product or air care product that contains said woody, ambery perfume composition as such, or as part of a fragrance formulation.

The disclosure also relates in yet another of its aspects to a method of providing a woody, ambery perfume accord reminiscent of KARANAL® to a fragrance formulation or perfumed article, without the use of KARANAL®, characterized in that a woody, ambery perfume composition defined herein below is incorporated into said fragrance formulation or perfumed article.

The disclosure also relates to the use of a woody, ambery perfume composition defined herein below, as a substitute for the ingredient KARANAL®, in the preparation of a woody, ambery perfume accord reminiscent of KARANAL®.

DETAILED DESCRIPTION OF THE INVENTION

A woody, ambery perfume composition is herein provided, which is useful in particular as a replacement for KARANAL®, in whole or in part, in fragrance formulations and perfumed articles.

As the term is used herein, a woody ambery perfume composition is a perfume composition that contains a mixture of perfume ingredients, but which in and of itself is not primarily intended to be used as a finished fragrance formulation. That is, a woody, ambery perfume composition of the present invention is primarily intended to be used as a component part in a finished fragrance formulation.

The term fragrance formulation as used herein is intended to connote a finished fragrance that contains the woody, ambery perfume composition as a component part. The fragrance formulation is intended to be used to impart a pleasant or desirable odour to all manner of articles of commerce, such as personal care products, household care products, air-care products and laundry care products.

Owing to the complex odour character of KARANAL®, the applicant discovered after considerable research that it is not possible to reproduce the odour and performance reminiscent of KARANAL® using only a single perfume ingredient, or indeed combinations for perfume ingredients selected from the existing palette of woody, ambery perfume ingredients currently available to perfumers, such is the unique odour and performance of KARANAL®. Any surrogate must have its basic woody ambery character, but it is also necessary to recover the sharp, radiant, fusing, burning effect of KARANAL®.

Accordingly, the invention provides a woody ambery perfume composition, free, or substantially free, of KARANAL® and comprising a mixture of at least three, at least four, at least five, at least six, at least seven, at least eight, at least nine, at least ten or more perfume ingredients selected from:

i) at least one primary perfume ingredient selected from the group consisting of (1'R,3S,6'S)-1-(2',2',6'-trimethyl-1'-cyclohexyl)-3-hexanol, (1'S,3S,6'R)-1-(2',2',6'- trimethyl-1'-cyclohexyl)-3-hexanol or any mixture thereof; AND an isomer or mixture of isomers of octahydro-2,2,5,8,8,9a-hexamethyl-4H-4a,9-methanoazuleno[5,6-d]-1,3-dioxole, including but not limited to (4aR,5R,7aS,9R)-octahydro-2,2,5,8,8,9a-hexamethyl-4H-4a,9-methanoazuleno[5,6-d]-1,3-dioxole; an isomer or mixture of isomers of 2-(TETRAMETHYLTRICYCLO[6.2.1.0]UNDEC-4/5-EN-5-YL)PROPANOL; and an isomer or mixture of isomers of DECAHYDRO-2,6,6,7,8,8-HEPTAMETHYL INDENOFURAN; AND ii) at least one secondary perfume ingredient selected from the group consisting of (Z)-4,11,11-trimethyl-8-methylenebicyclo[7.2.0]undec-4-ene, for example ACETYL CARYOPHYLLENE; 3a,6,6,9a-tetramethyl-2,4,5,5a,7,8,9,9b-octahydro-1H-benzo[e][1]benzofuran, for example AMBROXAN, AMBROFIX, AMBROX; (ethoxymethoxy)cyclododecane, for example BOISAMBRENE FORTE; 6-(sec-butyl)quinoline, for example BUTYL QUINOLINE SECONDARY; (1R,6S,8aS)-6-methoxy-1,4,4,6-tetramethyloctahydro-1H-5,8a-methanoazulene, for example CEDRYL METHYL ETHER; 2-(tert-pentyl)cyclohexyl acetate, for example CONIFERAN; 2-(2-(3,3,5-trimethylcyclohexyl)acetyl) cyclopentanone, for example DIONE; (1aS,2aR,3R, 5aS, 7R,7aR)-octahydro-3,6,6,7a-tetramethyl-2H-2a,7-methanozuleno 5,6-b oxirene, for example CEDRENE EPOXIDE; 3a,6,6,9a-tetramethyldodecahydronaphtho[2,1-b]furan, for example FIXAMBRENE; 2,4a,5,8a-tetramethyl-1,2,3,4,4a,7,8,8a-octahydronaphthalen-1-yl formate, for example OXYOCTALINE FORMATE; 1-(1,2,8,8-tetramethyl-1,2,3,4,5,6,7,8-octahydronaphthalen-2-yl)ethanone, for example GEORGYWOOD; 2,2,7,7-tetramethyltricyclo [6.2.1.01,6] undecanethan-5-one, for example ISOLONGIFOLANONE; (Z)-3,4,5,6,6-pentamethylhept-3-en-2-one, for example KOAVONE; 3,4,5,6,6-pentamethylheptan-2-ol, for example KOHINOOL or MADROX; 1-((1S,8aS)-1,4,4,6-tetramethyl-2,3,3a,4,5,8-hexahydro-1H-5,8a-methanoazulen-7-yl)ethanone, for example METHYL CEDRYL KETONE; 2,4-dimethyl-2-(5,5,8,8-tetramethyl-5,6,7,8-tetrahydronaphthalen-2-yl)-1,3-dioxolane, for example OKOUMAL; 2',2',3,7,7-pentamethylspiro[bicyclo[4.1.0]heptane-2,5'-[1,3]dioxane], for example SPIRAMBRENE; the stereoisomers (1'S,3R,6'R)-1-(2',2',6'-trimethyl-1'-cyclohexyl)-3-hexanol, (1'R,3R,6'S)-1-(2',2',6'-trimethyl-1'-cyclohexyl)-3-hexanol or a mixture thereof, found for example in TIMBEROL; 1-((2E,5Z,9Z)-2,7,8-trimethylcyclododeca-2,5,9-trien-1-yl)ethanone, for example TRIMOFIX O; 1-((1S,8aS)-1,4,4,6-tetramethyl-2,3,3a,4,5,8-hexahydro-1H-5,8a-methanoazulen-7-yl)ethanone, for example VERTOFIX COEUR; 2-methyl-4-(5,6,6-trimethylbicyclo[2.2.1]hept-2-yl-cyclohexanone, for example ALDRONE; 1-((2-(tert-butyl)cyclohexyl)oxy)butan-2-ol, for example AMBER CORE; 3,8,8,11a-tetramethyldodecahydro-1H-3,5a-epoxynaphtho[2,1-c]oxepine, for example AMBERKETAL; 3a,6,6,9a-tetramethyldodecahydronaphtho[2,1-b]furan, for example AMBROFIX; (1R,2S,4R)-2'-isopropyl-1,7,7-trimethylspiro[bicyclo[2.2.1]heptane-2,4'-[1,3]dioxane], for example BELAMBRE 50% solution in IPM; 2-(sec-butyl)-1-vinylcyclohexyl acetate, for example DIHYDRO AMBRATE; 4-(1-ethoxyvinyl)-3,3,5,5-tetramethylcyclohexanone, for example KEPHALIS; 2-(sec-butyl)-1-methylcyclohexyl acetate, for example METAMBRATE; 2-methylundecanoic acid, for example MYSTIKAL; 2-cyclohexylhepta-1,6-dien-3-one, for example PHARAONE; decahydro-2,6,6,7,8,8-hexamethyl-2H-indeno[4,5-b]furan, for example TRISAMBER; and hexahydro-1',1',5',5'-tetramethyl-spiro(1,3-dioxolane-2,8'(5'H)-(2H-2,4a) methanonaphthalene), for example YSAMBER; AND iii) optionally, at least one tertiary perfume ingredient selected from the group consisting of one or more stereoisomers of 1-(2,3,8,8-tetramethyl-1,2,3,4,5,6,7,8-octahydronaphthalen-2-yl)ethanone, for example ISO E SUPER, ISO GAMMA SUPER and SYLVAMBRENE.

The primary perfume ingredient octahydro-2,2,5,8,8,9a-hexamethyl-4H-4a,9-methanoazuleno[5,6-d]-1,3-dioxole may be employed in the form of a single stereoisomer, or any mixture of them. A commercial quality octahydro-2,2,5,8,8,9a-hexamethyl-4H-4a,9-methanoazuleno[5,6-d]-1,3-dioxole is known by its trade name AMBROCENIDE, which is available commercially from Symrise in two qualities, namely AMBROCENIDE® 10% solution in the common perfumery solvents DPG or TEC, and AMBROCENIDE® crystals, and either of these two commercial forms may be used in the present invention as a source of octahydro-2,2,5,8,8,9a-hexamethyl-4H-4a,9-methanoazuleno[5,6-d]-1,3-dioxole. The isomer responsible principally for its desired odour and performance in the context of the present invention is (4aR,5R,7aS,9R)-Octahydro-2,2,5,8,8,9a-hexamethyl-4H-4a,9-methanoazuleno[5,6-d]-1,3-dioxole, and it is preferred that if octahydro-2,2,5,8,8,9a-hexamethyl-4H-4a,9-methanoazuleno[5,6-d]-1,3-dioxole is employed, then this isomer or any mixture containing this isomer is employed.

DECAHYDRO-2,2,6,6,7,8,8-HEPTAMETHYL INDENOFURAN, having the following structure

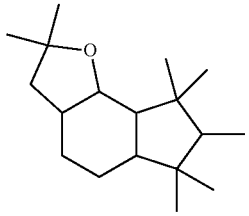

has multiple chiral centres and can be employed in the form of a single isomer or in any mixture of its isomers. A commercially available form of DECAHYDRO-2,2,6,6,7,8,8-HEPTAMETHYL INDENOFURAN is known by the trade name AMBER XTREME and is available from IFF. This branded quality of DECAHYDRO-2,2,6,6,7,8,8-HEPTAMETHYL INDENOFURAN may be employed in the present invention.

2-(TETRAMETHYLTRICYCLO[6.2.1.0]UNDEC-4/5-EN-5-YL)PROPANOL having the formula shown below has multiple chiral centres and also exhibits double bond isomerism

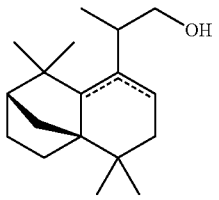

and as such it can exist singly in any of its pure isomers, or in any combination of its isomers. 2-(TETRAMETHYLTRICYCLO[6.2.1.0]UNDEC-4/5-EN-5-YL)PROPANOL may be used in the form of a single isomer, or in any mixture of isomers. A commercial form of 2-(TETRAMETHYLTRICYCLO[6.2.1.0]UNDEC-4/5-EN-5-YL)PROPANOL is known by its trade name AMBERMAX; which is available from Givaudan in two qualities viz AMBERMAX® 10% solution in TEC and AMBERMAX® 50% solution in DOWANOL TPM, either of which commercial qualities may be employed in the present invention.

1-(2',2',6'-trimethyl-1'-cyclohexyl)-3-hexanol having the following chemical structure

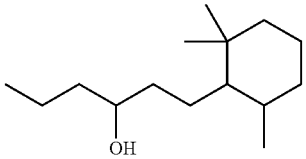

has multiple chiral centres and can exist singly in any of its pure isomers, or in any combination of its isomers. Particularly important ingredients for use in the present invention as primary ingredients are (1'R,3S,6'S)-1-(2',2',6'-trimethyl-1'-cyclohexyl)-3-hexanol and (1'S,3S,6'R)-1-(2',2',6'-trimethyl-1'-cyclohexyl)-3-hexanol (shown below) and any of their mixtures.

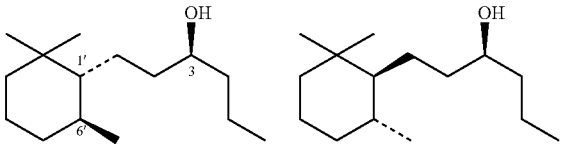

The stereo-isomers of 1-(2',2',6'-trimethyl-1'-cyclohexyl)-3-hexanol referred to above may be employed in the present invention in any convenient form, such as in the form of the branded material NIMBEROL, which is available commercially, for example from Privi Organics Ltd; or in the form of KARMAWOOD, which is commercially available from IFF; or in the form of NORLIMBANOL, which is available commercially from Firmenich.

As used herein, the term "free or substantially free of KARANAL®" means that the woody, ambery perfume composition either does not contain KARANAL®, or if it does contain KARANAL®, it is present at levels less than 1 wt %, and more particularly less than 0.5 wt %, less than 0.1 wt %, less than 0.05 wt %, less than 0.01 wt %, less than 0.001 wt % of the total weight of the woody, ambery perfume composition.

In an embodiment of the present invention the primary perfume ingredient or ingredients account for 10 to 99.8 wt %, more particularly 20 to 99.8 wt %, still more particularly 40 to 99.8 wt %, more particularly 60 to 99.8 wt %, more particularly 80 to 98 wt %, and more particularly still 85 to 95 wt % of the woody, ambery perfume composition.

In a woody, ambery perfume composition of the present invention (1'R,3S,6'S)-1-(2',2',6'-trimethyl-1'-cyclohexyl)-3-hexanol, (1'S,3S,6'R)-1-(2',2',6'-trimethyl-1'-cyclohexyl)-3-hexanol or any mixture thereof may be present in an amount of 4.5 to 90 wt %, more particularly 10 to 90 wt %, more particularly 20 to 90 wt %, more particularly 45 to 90 wt %, more particularly from 55 to 85 wt % and still more particularly from 60 to 80 wt % based on the total weight of said composition.

In a woody, ambery perfume composition of the present invention, the sum of the concentration of AMBROCENIDE, AMBERMAX, and AMBER XTREME may be from 0.1 to 50 wt %, more particularly 1 to 50 wt %, more particularly from 10 to 40 wt % and still more particularly from 15 to 30 wt % based on the total weight of said composition.

Particularly when employed at the levels referred to hereinabove, the primary perfume ingredients provide the composition with a woody, ambery odour odour and a powerful technical performance, substantially similar to that of KARANAL®. Further still, these ingredients, when incorporated into the woody, ambery perfume composition introduce a sharp, mineral facet to the composition as a whole, which is characteristic of KARANAL®.

Hence, combinations of the aforementioned isomers of 1-(2',2',6'-trimethyl-1'-cyclohexyl)-3-hexanol that can be found in branded perfume ingredients such as NIMBEROL, KARMAWOOD or NORLIMBANOL, but particularly in NIMBEROL; in combination with the aforementioned isomer of isomers of AMBROCENIDE, and particularly those present in commercially available AMROCENIDE in its crystalline form or in solution; and/or in combination with the aforementioned isomer or isomers of AMBER XTREM, together form a particularly useful primary perfume ingredient component of the present invention.

Similarly, combinations of the aforementioned isomers of 1-(2',2',6'-trimethyl-1'-cyclohexyl)-3-hexanol that can be found in branded perfume ingredients such as NIMBEROL, KARMAWOOD or NORLIMBANOL, but particularly in NIMBEROL; in combination with the aforementioned isomer or isomers of AMBERMAX, and in particular the commercially available forms of AMBERMAX, together form another particularly useful primary perfume ingredient component of the present invention.

The at least one secondary perfume ingredient is typically employed in an amount of 0.02 to 40 wt %, more particularly 0.1 to 40 wt % more particularly from 2 to 20 wt % and still more particularly from 5 to 15 wt % based on the total weight of the woody, ambery perfume composition.

The at least one secondary perfume ingredient may be selected from the stereoisomers (1'S,3R,6'R)-1-(2',2',6'-trimethyl-1'-cyclohexyl)-3-hexanol,(1'R,3R,6'S)-1-(2',2',6'-trimethyl-1'-cyclohexyl)-3-hexanol or mixtures thereof, which may be provided for example by TIMBEROL; 3a,6,6,9a-tetramethyl-2,4,5,5a,7,8,9,9b-octahydro-1H-benzo[e][1]benzofuran, for example AMBROXAN, AMBROFIX, AMBROX; 2,4-dimethyl-2-(5,5,8,8-tetramethyl-5,6,7,8-tetrahydronaphthalen-2-yl)-1,3-dioxolane, for example OKOUMAL; 2',2',3,7,7-pentamethylspiro[bicyclo[4.1.0]heptane-2,5'-[1,3]dioxane], for example SPIRAMBRENE; 1-((2-(tert-butyl)cyclohexyl)oxy)butan-2-ol, for example AMBER CORE; 3,8,8,11a-tetramethyldodecahydro-1H-3,5a-epoxynaphtho[2,1-c]oxepine, for example AMBER- KETAL; 2-methylundecanoic acid, for example MYSTIKAL; hexahydro-1',1',5',5'-tetramethyl-spiro(1,3-dioxolane-2,8'(5'H)-(2H-2,4a)methanonaphthalene), for example YSAMBER; Decahydro-2,6,6,7,8,8-hexamethyl-2H-indeno[4,5-b]furan, for example TRISAMBER; and 2-methyl-4-(5,6,6-trimethylbicyclo[2.2.1]hept-2-yl-cyclohexanone, for example ALDRONE.

In an embodiment of the present invention, the sum of the concentrations of the secondary perfume ingredients (1'S,3R,6'R)-1-(2',2',6'-trimethyl-1'-cyclohexyl)-3-hexanol, (1'R,3R,6'S)-1-(2',2',6'-trimethyl-1'-cyclohexyl)-3-hexanol or their mixtures is from of 0.45 to 9 wt %, more particularly 4.5 to 9 wt %, more particularly from 5 to 8.5 wt % and still more particularly from 6 to 8 wt % based on the total weight of the woody, ambery perfume composition.

In an embodiment of the invention the sum of the concentrations of the secondary perfumery ingredients 3a,6,6,9a-tetramethyl-2,4,5,5a,7,8,9,9b-octahydro-1H-benzo[e][1]benzofuran, for example AMBROXAN, AMBROFIX, AMBROX; 2,4-dimethyl-2-(5,5,8,8-tetramethyl-5,6,7,8-tetrahydronaphthalen-2-yl)-1,3-dioxolane, for example OKOUMAL; hexahydro-1',1',5',5'-tetramethyl-spiro(1,3-dioxolane-2,8'(5'H)-(2H-2,4a)methanonaphthalene), 2',2',3,7,7-penta methylspiro[bicyclo[4.1.0]heptane-2,5'-[1,3]dioxane], for example SPIRAMBRENE; for example YSAMBER; Decahydro-2,6,6,7,8,8-hexamethyl-2H-indeno[4,5-b]furan, for example TRISAMBER; and 2-methyl-4-(5,6,6-trimethylbicyclo[2.2.1]hept-2-yl-cyclohexanone, for example ALDRONE, is from 0.01 to 35 wt %, more particularly 0.1 to 35 wt %, more particularly from 2 to 15 wt %, still more particularly from 3 to 8 wt % based on the total weight of the woody, ambery perfume composition.

In an embodiment of the invention the sum of the concentrations of the secondary perfumery ingredient 2-methylundecanoic acid, for example MYSTIKAL; and 3,8,8,11a-tetramethyldodecahydro-1H-3,5a-epoxynaphtho[2,1-c]oxepine, for example AMBERKETAL is from of 0.001 to 0.15 wt %, more particularly 0.005 to 0.15 wt %, more particularly from 0.08 to 0.08 wt % and still more particularly from 0.012 to 0.025 wt % based on the total weight of the woody, ambery perfume composition.

Particularly when employed at the levels referred to hereinabove, the at least one secondary perfume ingredient when combined with the primary and optionally tertiary ingredients in the composition provides the perfume composition as a whole with the odour nuances of KARANAL®, and in particular adds a dry aspect that is particularly characteristic of KARANAL®.

In an embodiment of the invention the secondary perfume ingredient is selected from the stereoisomers (1'S,3R,6'R)-1-(2',2',6'-trimethyl-1'-cyclohexyl)-3-hexanol and (1'R,3R,6'S)-1-(2',2',6'-trimethyl-1'-cyclohexyl)-3-hexanol or mixtures thereof, provided for example by TIMBEROL; 2-methylundecanoic acid, for example MYSTIKAL; and 2-methyl-4-(5,6,6-trimethylbicyclo[2.2.1]hept-2-yl-cyclohexanone, for example ALDRONE, wherein the ratio of the concentration of 2-methyl-4-(5,6,6-trimethylbicyclo[2.2.1]hept-2-yl-cyclohexanone to the sum of the concentrations of primary perfume ingredients (1'R,3S,6'S)-1-(2',2',6'-trimethyl-1'-cyclohexyl)-3-hexanol and (1'S,3S,6'R)-1-(2',2',6'-trimethyl-1'-cyclohexyl)-3-hexanol is from 0.02 to 0.5, more particularly from 0.03 to 0.25 and still more particularly from 0.05 to 0.15.

If optional tertiary ingredients are employed, then they may be added to the primary and secondary ingredients, and in any proportion having regard to the particular effect a perfumer is trying to achieve.

The tertiary ingredients may be used in the woody, ambery perfume composition as fillers. As used herein, the term "filler" refers to an ingredient that can be described as having a "transparent" character. That is, the impact of the perfume ingredient as a function of its concentration is substantially constant over a large concentration range. This means that the ingredient can be used over wide ranging concentrations without its odour characteristics dominating the perfume composition. In other words, its odour characteristic at relatively low concentration remains essentially the same over a wide range of concentrations. Such ingredients are particularly useful when employed at high concentrations in a perfume composition, particularly if they are relatively inexpensive ingredients.

In this regard, ISO E SUPER, ISO GAMMA SUPER, and SYLVAMBER are particularly preferred fillers, which can be employed in an amount of up to about 90 wt %, more particularly 50 to 95%, and still more particularly 75 to 90 wt % based on the total weight of the woody, ambery perfume composition.

Certain non-perfumery ingredients may be added to the woody, ambery perfume composition according to the present invention, in addition to the perfume ingredients recited hereinabove. Useful non-perfumery ingredients include perfume carriers for one or more of the perfume ingredients recited above.

A perfume carrier refers to a material that either does not, or is not intended to, substantially alter the organoleptic properties of perfume ingredients. The carrier may be a liquid or a solid.

The liquid carrier may be an emulsifying system, such as a surfactant system, or a solvent commonly used in perfumery, or both. The person skilled in the art is aware of the extensive list of solvents that are available for use in perfumery, and discussion of the type of solvents commonly used in perfumery cannot be dealt with exhaustively herein. However, one can cite as non-limiting examples solvents such as dipropyleneglycol, diethyl phthalate, isopropyl myristate, benzyl benzoate, 2-(2-ethoxyethoxy)-l-ethanol, tri-ethyl citrate, ethanol, water/ethanol mixtures, isopropanol, limonene or other terpenes, isoparaffins such as those known under the trademark ISOPAR® or glycol ethers and glycol ether esters such as those known under the trademark DOWANOL®, MIGLYOL 840, and dibasic esters.

The amount of solvent employed to dilute the woody, ambery perfume composition according to the invention may be up to 99 wt %, more particularly up to 50%, and still more particularly up to 30 wt % based on the total weight of the woody, ambery perfume composition.

Certain perfume ingredients may be able to solubilize, to some extent, other perfume ingredients. However, for the purpose of calculating the amount of solvent employed in compositions of the present invention, perfume ingredients specifically recited in this document, or those not specifically recited but known as perfume ingredients by persons skilled in the art, or from standard perfumery reference works such as thegoodscentcompany and leffingwell websites, shall not be treated as solvents for the purpose of the present invention.

Solid carriers may include absorbing gums or polymers, or encapsulating materials. Examples of such materials may comprise wall-forming and plasticizing materials, such as mono, di- or trisaccharides, natural or modified starches, hydrocolloids, cellulose derivatives, polyvinyl acetates, polyvinylalcohols, proteins, pectins, aminoplast resins, acrylic-based resins, polyurea, polyurethane, as well as mixtures of inorganic and organic materials. Encapsulation of perfumery ingredients is well known in the art, and may be performed, for instance, using techniques such as spray-drying, agglomeration or yet extrusion; or consists of a coating encapsulation, including coacervation and complex coacervation technique. All encapsulating materials, including polymers, resins and the like, formed by all common encapsulation techniques are contemplated as carrier materials within the context of the present invention.

Perfume compositions of the present invention may contain perfume adjuvants. A perfume adjuvant, as the term is used herein, refers to a material that is capable of imparting additional added benefits to a composition such as a color, a particular light resistance, chemical stability, or the like. A detailed description of the nature and types of adjuvant commonly used in perfumery is not warranted here as they are well known to persons skilled in the art.

The woody, ambery perfume composition of the present invention may contain at least two, more particularly at least three, and still more particularly at least four primary perfume ingredients, and each combination of these primary perfume ingredients is contemplated for use in woody, ambery perfume compositions of the present invention.

In an embodiment of the present invention the woody, ambery perfume composition contains a mixture of the primary perfume ingredients recited hereinabove, together with at least one, at least two, or at least three secondary perfume ingredients.

In a more particular embodiment, the woody, ambery perfume composition contains a mixture of the primary perfume ingredients recited hereinabove, in combination with the at least one, at least two, or at least three of the following secondary perfume ingredients, preferably selected from ALDRONE, MYSTIKAL, OKOUMAL, AMBERKETAL, AMBER CORE, TRISAMBER and SPIRAMBRENE.

Combinations of NIMBEROL, NORLIMBANOL or KARMAWOOD, with AMBROCENIDE, AMBER XTREM or AMBERMAX and ALDRONE and MYSTIKAL; or OKOUMAL and AMBERKETAL; or ALDRONE and AMBER CORE; or ALDRONE, MYSTIKAL and AMBER CORE; or SPIRAMBRENE; or TRISAMBER are useful in the context of this invention.

A particular woody, ambery perfume composition employs as primary and secondary ingredients, NIMBEROL, AMBERMAX, SPIRAMBRENE and a solvent, e.g. DPG, in amounts referred to hereinabove.

Another particular woody, ambery perfume composition employs as primary and secondary ingredients, NIMBEROL, AMBERMAX 10%, AMBROCENIDE 10% or more preferably AMBROCENIDE crystal, MYSTICAL, ALDRONE and AMBER XTREME and a solvent, e.g. DPG, and/or a filler, e.g. ISO E SUPER in amounts referred to hereinabove.

Another particular woody, ambery perfume composition employs as primary and secondary ingredients, AMBERMAX 10%, AMBROCENIDE crystal, MYSTICAL, ISO E SUPER, PHARAONE 10%, ALDRONE and AMBER XTREME and a solvent, e.g. DPG and/or a filler, e.g. ISO E SUPER in amounts referred to hereinabove.

Another particular woody, ambery perfume composition employs as primary and secondary ingredients, NIMBEROL, AMBERMAX 10%, AMBROCENIDE crystal, OKUMAL and a solvent, e.g. DPG and/or a filler, e.g. ISO E SUPER in amounts referred to hereinabove.

Another particular woody, ambery perfume composition employs as primary and secondary ingredients, NIMBEROL, AMBERMAX 10%, AMBROCENIDE crystal, TRISAMBER and a solvent, e.g. DPG and/or a filler, e.g. ISO E SUPER in amounts referred to hereinabove.

Another particular woody, ambery perfume composition employs as primary and secondary ingredients, NIMBEROL, AMBERMAX 10%, AMBROCENIDE crystal, AMBER CORE and a solvent, e.g. DPG and/or a filler, e.g. ISO E SUPER in amounts referred to hereinabove.

In a side by side comparison of the woody, ambery perfume composition and KARANAL®, perfumers remark how similar they are both in terms of hedonic character and performance. This is surprising considering that neither the primary perfume ingredients, which provide the general olfactive character, nor the secondary perfume ingredients, which provide the odour nuance, are very similar to the odour profile of KARANAL®. However, when combined in the manner described herein the ingredients perform together to provide the perception of KARANAL®.

Accordingly, whereas the woody, ambery perfume composition could be used directly in fine or technical perfumery to perfume consumer products, it is intended primarily to be used as a component, replacing KARANAL®, in a finished fragrance formulation. As such, it may be used as a component in a fragrance formulation at the level that KARANAL® would be ordinarily employed.

Accordingly, the invention provides in another of its aspects a fragrance formulation comprising the woody, ambery perfume composition, as defined herein.

In a particular embodiment, the fragrance formulation comprises the woody, ambery perfume composition, as herein defined herein in an amount of 0.05 to 20 wt %, more particularly 0.1 to 10 wt %, more particular 0.25 to 7.5 wt %, and still more particularly 0.5 to 5 wt % based on the total weight of the fragrance formulation.

When a woody, ambery perfume composition is intended to be used as a component in a fragrance formulation, it is mixed with a perfumery base.

A perfumery base, as the term is used herein, refers to a mixture of perfumery co-ingredients, none of which is a primary, secondary or optional tertiary ingredient referred to hereinabove.

Perfumery co-ingredients are ingredients whose significant function as recognized by skilled perfumers is to impart or modify in a positive, pleasant or desired way, the odour of a fragrance formulation. The nature and type of the perfuming co-ingredients present in the base do not warrant a more detailed description here, which in any case would not be exhaustive, the skilled person being able to select them on the basis of his or her general knowledge and according to intended use or application and the desired organoleptic effect. In general terms, these perfumery co-ingredients belong to chemical classes as varied as alcohols, lactones, aldehydes, ketones, esters, ethers, acetates, nitriles, terpenoids, nitrogenous or *sulphurous* heterocyclic compounds and essential oils, and said perfumery co-ingredients can be of natural or synthetic origin. Many of these co-ingredients are in any case listed in reference texts such as the book by S. Arctander, Perfume and Flavor Chemicals, 1969, Montclair, N.J., USA, or its more recent versions, or in other works of a similar nature, such as thegoodscent-company.com and leffingwell websites, as well as in the abundant patent literature in the field of perfumery.

It is also understood that said perfumery co-ingredients may also be compounds known to release in a controlled manner various types of perfuming compounds, such as perfume precursors that are themselves not recognized as perfume ingredients, but which can degrade under the influence of an external stimulus such as light or heat or chemical interaction to release a perfume co-ingredient.

The woody, ambery perfume composition, according to the present invention, is particularly suitable for use in fragrance formulations intended to impart woody, chypre, fougere (fern), citrus, marine, leather, spicy, floral, fruity and sweet-gourmand odours.

In a particular embodiment, a fragrance formulation is prepared by mixing a woody, ambery perfume composition as herein above described, with one or more perfumery co-ingredients selected from hexyl acetate, for example AGAR WOOD; AKIGALAWOOD, AMYRIS ACETATE; (1 1,1,2,3,3-pentamethyl-2,3,6,7-tetrahydro-1H-inden-4 (5H)-one, for example CASHMERAN; (4Z,8Z)-1,5,9-trimethyl-13-oxabicyclo[10.1.0]trideca-4,8-diene, for example CEDROXYDE; S,6R,8aR)-1,4,4,6-tetramethyloctahydro-1H-5,8a-methanoazulen-6-yl acetate, for example CEDRYL ACETATE, CEDRYL ACETATE EOA and CEDRYL ACETATE LIQUID; 2-(3,8-dimethyl-1,2,3,4,5,6,7,8-octahydroazulen-5-yl)propan-2-yl acetate, for example GUAIYL ACETATE; (2-methoxy-4-prop-1-enylphenyl) acetate, for example ISOCARYOL ACETATE; (4,8-dimethyl-2-propan-2-ylidene-3,3a,4,5,6,8a-hexahydro-1H-azulen-6-yl) acetate, for example VETIVERYL ACETATE, VETIVERYL ACETATE 112 EXTRA, VETIVERYL and ACETATE HAITI PURE; N-ethyl-N-(m-tolyl)propionamide, for example AGARBOIS; AMYRIS OIL DOMINICAN REPUBLIC; COPAHU OIL; CEDARWOOD OIL ATLAS ORPUR COSMOS; CEDARWOOD OIL CHINA; CEDARWOOD OIL RECTIFIED; CEDARWOOD OIL TEXAS FRACTION COSMOS; CEDARWOOD OIL TEXAS RECTIFIED COSMOS; CEDARWOOD OIL TEXAS LIGHT PURE; CEDARWOOD OIL USA VIRGINIA TYPE ORPUR; OAKWOOD EXTRACT CO2/ETHANOL; GUAIACWOOD OIL PARAGUAY; GUAIACWOOD OIL SR; SANDALWOOD 77125/D; SANDALWOOD OIL AUSTRALIA INDIGENOUS; SANDALWOOD OIL AUSTRALIA SD COSMOS; (1S,2R,5R)-2-ethoxy-2,6,6-trimethyl-9-methylenebicyclo[3.3.1]nonane, for example BOISIRIS; BIRCH TAR OIL RECTIFIED; CABREUVA OIL PARAGUAY; (1S,4R)-2,2-dimethyl-3-methylenebicyclo[2.2.1]heptane, for example CAMPHENE; (1S,8aR)-1,4,4,6-tetramethyl-2,3,3a,4,5,8-hexahydro-1H-5,8a-methanoazulene, for example CEDRENE WASHED; ((1S,8aR)-1,4,4-trimethyl-2,3,3a,4,5,8-hexahydro-1H-5,8a-methanoazulen-6-yl)methanol, for example CEDRENOL; (1S,6R,8aR)-1,4,4,6-tetramethyloctahydro-1H-5,8a-methanoazulen-6-ol, for example CEDROL CRYSTALS EXTRA; CISTUS OIL SPAIN ORPUR; CYPRESS OIL FRANCE ORPUR COSMOS; CYPRESS OIL SPAIN; CYPRIOL OIL INDIA; (E)-3-methyl-5-(2,2,3-trimethylcyclopent-3-en-1-yl)pent-4-en-2-ol, for example EBANOL; OLIBANUM BAUMAROME STD; OLIBANUM HYPERESSENCE; OLIBANUM ODORESIN; methyl 2,4-di hydroxy-3,6-di methylbenzoate, for example EVERNYL; 4,4,8,8-tetramethyloctahydro-4a,7-methanonaphtho[1,8a-b] oxirene, for example FOLENOX; 1,2,3,4,4a,5,6,7,8,8a-decahydronaphthalen-2-yl formate, for example DECAHYDRO NAPHTYL FORMATE BETA; 3a-ethyl-6,6,9a-trimethyldodecahydronaphtho[1,2-c]furan, for example GRISALVA; GUAIACWOOD (PHENOL FREE) PURE; GURJUN BALSAM OIL LIGHT; IONANTHEME 100%; (E)-3-methyl-4-(2,6,6-trimethylcyclohex-2-en-1-yl)but-3-en-2-one, for example IRISANTHEME; (E)-4-(2,5,6,6-tetramethyl-1-cyclohex-2-enyl)but-3-en-2-one, for example IRONAL; (E)-3-methyl-4-(2,6,6-trimethylcyclohex-2-en-1-yl)but-3-en-2-one, for example ISORALDEINE CETONE ALPHA; (1-methyl-2-((1,2,2-trimethylbicyclo[3.1.0]hexan-3-yl)methyl)cyclopropyl)methanol, for example JAVANOL; LABDANUM LAREXTRACT COLOURLESS; METHYL IONONE GAMMA PURE TECH; OPOPONAX BAUMAROME 54 7504; 3-methoxy-5-methylphenol, for example ORCINYL 3; 4-(tert-pentyl)cyclohexanone, for example ORIVONE; 7-methoxy-3,7-dimethyloctan-2-ol, for example OSYROL; 4-(tert-butyl)cyclohexanol, for example PARA TERT BUTYL CYCLOHEXANOL; 4-(tert-butyl) cyclohexanone, for example PARA TERT BUTYL CYCLOHEXANONE; (1-methyl-2-(((1R,3R)-2,2,3-trimethylcyclopentyl)methyl)cyclopropyl) methanol, for example PASHMINOL; PATCHOULI ABS; PATCHOULI DM PUR; PATCHOULI OIL COLORLESS INDONESIA; PATCHOULI OIL INDONESIA; PATCHOULI OIL IRON-FREE INDONESIA COSMOS; PATCHOULI OIL LIMONENE-FREE; 3,7-dimethylocta-1,6-dien-3-yl dimethylcarbamate, for example PEPPERWOOD; (8aR)-4,4,8,8-tetramethylhexahydro-1H-3,8a-methanonaphthalen-5(6H)-one, for example PICONIA; PINE ABSOLUTE COLORLESS; (E)-3,3-dimethyl-5-(2,2,3-trimethyl-3-cyclopenten-1-yl)-4-penten-2-ol, for example POLYSANTOL; (E)-2-ethyl-4-(2,2,3-trimethylcyclopent-3-en-1-yl) but-2-en-1-ol, for example RADJANOL and RADJANOL SUPER; 3-methyl-5-(2,2,3-trimethylcyclopent-3-en-1-yl) pentan-2-ol, for example SANDALORE EXTRA; 3-((1R, 2S,4R,6R)-5,5,6-trimethylbicyclo[2.2.1]heptan-2-yl)cyclohexanol, for example SAN DELA CONCENTRATED; 4,5, 6,7,8,9,10,11,12,13-decahydrocyclododeca[d]oxazole, for example SCLARENE 50%/TEC; SYLVENE; TEAK BASE; (5R,6R)-6,10-dimethyl-3-propan-2-ylidenespiro [4.5]dec-9-en-8-ol, for example VETIVENOL; VETIVER CO2 PURE; VETIVER ECO ESSENCE IFRA; VETIVER OIL DM; VETIVER OIL HAITI ORPUR ORGANIC COSMOS; VETIVER OIL HAITI DRIED FILTERED; VETIVER OIL PURE; VETIVER FRACTION HAITI ORPUR; (2R,5R,8S)-4,4,8-trimethyltricyclo[6.3.1.02,5]dodecan-1-yl acetate, for example VETYNAL and VETYNAL EXTRA; VETYRISIA; VETYSANTAL 3559P; [(3Z)-4,11, 11-trimethyl-8-methylidene-5-bicyclo[7.2.0]undec-3-enyl] acetate, for example VETIVENAL; mixture of (5R,6R)-6, 10-dimethyl-3-propan-2-ylidenespiro[4.5]dec-9-en-8-ol and 4,8-dimethyl-2-propan-2-ylidene-3,3a,4,5,6,8a-hexahydro-1H-azulen-6-ol VETIVEROL; AMBRAIN; AMBRAROME ABSOLU; AMBREINE NAOH; AMBREINE PURE; AMBREINOL; TOLU BALSAM RESINOID WASHED; BLACK AGAR GIVCO 215; CISTAMBRAL; CISTUS ABSOLUTE SB SPAIN; CISTUS BIOABSOLUE; CISTUS LABDANUM SB SPAIN; DYNAMONE SB; OLIBANUM RESINOID WASHED SB 50%/DPG; GRISAMBROL D 947173; HYDROCARBORESINE SB; LABDANUM RESINOIDE LG; MADRANOL; and TONKA ROASTED ABS 30%/ETH ORGANIC COSMOS; ACETATE C 6 HEXYLIC; (E)-2-methoxy-4-(prop-1-en-1-yl)phenyl acetate, for example ACETYL ISOEUGENOL CRYSTALS; 2,6,10-trimethylundec-9-enal, for example ADOXAL; 2-(tert-butyl)cyclohexyl acetate, for example AGRUMEX; decanal, for example ALDEHYDE C 10 DECYLIC; undec-10-enal, for example ALDEHYDE C 11 UNDECYLENIC; dodecanal, for example ALDEHYDE C 12 LAURIC; 2-methylundecanal, for example ALDEHYDE C 12 MNA PURE; (E)-undec-9-enal, for example ALDEHYDE ISO C 11; allyl 2-(isopentyloxy)acetate, for example ALLYL AMYL GLYCOLATE; allyl 3-cyclohexylpropionate, for example ALLYL CYCLOHEXYL PROPIONATE; allyl heptanoate, for example ALLYL OENANTHATE; (Z)-oxacycloheptadec-10-en-2-one, for example AMBRETTOLIDE; pentyl 2-hydroxybenzoate, for example AMYL SALICYLATE; 4-methoxybenzaldehyde, for example AUBEPINE PARA CRESOL; benzaldehyde, for example BENZALDEHYDE; benzyl acetate, for example BENZYL ACETATE EXTRA; benzyl benzoate, for example BENZYL BENZOATE; benzyl 2-hydroxybenzoate, for example BENZYL SALICYLATE; (2S,4S)-1,7,7-trimethylbicyclo[2.2.1]heptan-2-yl acetate, for example BORNYL ACETATE LIQUID; 3-(4-(tert-butyl)phenyl)propanal, for example BOURGEONAL T; 7-methyl-2H-benzo[b][1,4]dioxepin-3(4H)-one, for example CALONE 1951; (E)-3-phenylprop-2-en-1-ol, for example CINNAMIC ALCOHOL SYNTHETIC; (E)-3,7-dimethylocta-2,6-dienal, for example CITRAL LEMAROME N; 3,7-dimethyloct-6-en-1-ol, for example CITRONELLOL EXTRA; 3,7-dimethyloct-6-en-1-yl acetate, for example CITRON ELLYL ACETATE; 2H-chromen-2-one, for example COUMARIN PURE CRYSTALS; 1-methoxy-4-methylbenzene, for example CRESYL METHYL ETHER PARA; 2,4-dimethylcyclohex-3-enecarbaldehyde, for example CYCLAL C; 3-(4-isopropylphenyl)-2-methylpropanal, for example CYCLAMEN ALDEHYDE EXTRA; allyl 2-(cyclohexyloxy)acetate, for example CYCLOGALBANATE; 4-(4-hydroxy-4-methylpentyl)cyclohex-3-enecarbaldehyde, for example CYCLOHEXAL; (E)-1-(2,6,6-trimethylcyclohexa-1,3-dien-1-yl)but-2-en-1-one, for example DAMASCENONE; (E)-1-(2,6,6-trimethylcyclohex-2-en-1-yl)but-2-en-1-one, for example DAMASCONE ALPHA; (E)-1-(2,6,6-trimethylcyclohex-1-en-1-yl)but-2-en-1-one, for example DAMASCONE BETA; (E)-1-(2,6,6-trimethylcyclohex-3-en-1-yl)but-2-en-1-one, for example DAMASCONE DELTA; 5-hexyloxolan-2-one, for example DECALACTONE GAMMA; Cyclopentadecanone, for example DIHYDRO MYRCENOL; 2-methyl-1-phenylpropan-2-yl acetate, for example DIMETHYL BENZYL CARBINYL ACETATE; oxydibenzene, for example DIPHENYL OXIDE; ethyl butanoate, for example ETHYL BUTYRATE; (E)-3,7-dimethylnona-1,6-dien-3-ol, for example ETHYL LINALOOL; 2-ethyl-3-hydroxy-4H-pyran-4-one, for example ETHYL MALTOL; ethyl 2-methylbutanoate, for example ETHYL METHYL-2-BUTYRATE; 3-ethoxy-4-hydroxybenzaldehyde, for example ETHYL VANILLIN; 1,4-dioxacycloheptadecane-5,17-dione, for example ETHYLENE BRASSYLATE; Dodecanal, for example EUGENOL PURE COSMOS; 4-allyl-2-methoxyphenol, for example EUGENOL RECTIFIED; 3-(4-methoxyphenyl)-2-methylpropanal, for example FENNALDEHYDE; 1-(3,5,5,6,8,8-hexamethyl-5,6,7,8-tetrahydronaphthalen-2-yl)ethanone, for example FIXOLIDE; 3-(4-ethylphenyl)-2,2-dimethylpropanal, for example FLORALOZONE; 3-(3-isopropyl phenyl)butanal, for example FLORHYDRAL; (3aR,6S,7aS)-3a,4,5,6,7,7a-hexahydro-1H-4,7-methanoinden-6-yl propionate, for example FLOROCYCLENE; tetrahydro-4-methyl-2-(2-methylpropyl)-2H-pyran-4-ol, for example FLOROSA; tetra hydro-4-methyl-2-(2-methylpropyl)-2H-pyran-4-ol, for example FLOROSA HC; 4,6,6,7,8,8-hexamethyl-1,3,4,6,7,8-hexahydrocyclopenta[g]isochromene, for example GALAXOLIDE; 1-(5,5-dimethylcyclohex-1-en-1-yl)pent-4-en-1-one, for example GALBANONE 10; for example GARDENOL; (E)-3,7-dimethylocta-2,6-dien-1-ol, for example GERANIOL 980; (E)-3,7-dimethylocta-2,6-dien-1-ol, for example GERANIOL INTERMEDIATE 60; (E)-3,7-dimethylocta-2,6-dien-1-yl acetate, for example GERANYL ACETATE SYNTHETIC; (E)-oxacyclohexadec-12-en-2-one, for example HABANOLIDE; methyl 3-oxo-2-pentylcyclopentaneacetate, for example HEDIONE; benzo[d][1,3]dioxole-5-carbaldehyde, for example HELIOTROPINE CRYSTALS; (Z)-hex-3-en-1-ol, for example HEXENOL-3-CIS; (Z)-hex-3-en-1-yl acetate, for example HEXENYL-3-CIS ACETATE; (Z)-hex-3-en-1-yl 2-hydroxybenzoate, for example HEXENYL-3-CIS SALICYLATE; (E)-2-benzylideneoctanal, for example HEXYL CINNAMIC ALDEHYDE; hexyl 2-hydroxybenzoate, for example HEXYL SALICYLATE; 7-hydroxy-3,7-dimethyloctanal, for example HYDROXYCITRONELLAL SYNTHETIC; 1H-indole, for example INDOLE PURE; (E)-4-(2,6,6-trimethylcyclohex-1-en-1-yl)but-3-en-2-one, for example IONONE BETA; 1-(2,3,8,8-tetramethyl-1,2,3,4,5,6,7,8-octahydronaphthalen-2-yl)ethanone, for example ISO E SUPER; isopentyl acetate, for example ISOAMYL ACETATE EXTRA; (E)-2-methoxy-4-(prop-1-en-1-yl)phenol, for example ISOEUGENOL; isopropyl tetradecanoate, for example ISOPROPYL MYRISTATE; (E)-3-methyl-4-(2,6,6-trimethylcyclohex-2-en-1-yl)but-3-en-2-one, for example ISORALDEINE 70; (E)-3-methyl-4-(2,6,6-trimethylcyclohex-2-en-1-yl)but-3-en-2-one, for example ISORALDEINE 95; (3aR,6S,7aS)-3a,4,5,6,7,7a-hexahydro-1H-4,7-methanoinden-6-yl acetate, for example JASMACYCLENE; (Z)-3-methyl-2-(pent-2-en-1-yl)cyclopent-2-enone, for example JASMONE CIS; (1-methyl-2-((1,2,2-trimethylbicyclo[3.1.0]hexan-3-yl)methyl)cyclopropyl) methanol, for example JAVANOL; (Z)-hex-3-en-1-yl methyl carbonate, for example LIFFAROME GIV; 3-(4-(tert-butyl)phenyl)-2-methylpropanal, for example LILIAL; 3,7-dimethylocta-1,6-dien-3-ol, for example LINALOOL SYNTHETIC; 3,7-dimethylocta-1,6-dien-3-yl acetate, for example LINALYL ACETATE SYNTHETIC; ethyl 2-methylpentanoate, for example MANZANATE; 2,6-dimethylhept-5-enal, for example MELONAL; methyl 2-aminobenzoate, for example METHYL ANTHRANILATE EXTRA; methyl benzoate, for example METHYL BENZOATE; 1-((1S,8aS)-1,4,4,6-tetramethyl-2,3,3a,4,5,8-hexahydro-1H-5,8a-methanoazulen-7-yl)ethanone, for example METHYL CEDRYL KETONE; methyl non-2-ynoate, for example METHYL OCTYNE CARBONATE; 6,6-dimethoxy-2,5,5-trimethylhex-2-ene, for example METHYL PAMPLEMOUSSE; methyl 2-hydroxybenzoate, for example METHYL SALICYLATE; (Z)-3-methylcyclopentadec-5-enone, for example MUSCENONE; (Z)-3,7-dimethylocta-2,6-dien-1-yl acetate, for example NERYL ACETATE HC; 1-(2-naphtalenyl)-ethanone, for example ORANGER CRYSTALS; 5-heptyldihydrofuran-2(3H)-one, for example PEACH PURE; 2-cyclohexylidene-2-phenylacetonitrile, for example PEONILE; 2-phenethyl acetate, for example PHENYL ETHYL ACETATE; 2-phenylethanol, for example PHENYL ETHYL ALCOHOL; 3-methylbut-2-en-1-yl acetate, for example PRENYL ACETATE; 5-pentyldihydrofuran-2(3H)-one, for example PRUNOLIDE; 4-(4-hydroxyphenyl)butan-2-one, for example RASPBERRY KETONE (N112); 2,2,2-trichloro-1-phenylethyl acetate, for example ROSACETOL; 4-methyl-2-(2-methylprop-1-en-1-yl)tetrahydro-2H-pyran, for example ROSE OXIDE CO; 2-(4-methylcyclohex-3-en-1-yl)propan-2-ol, for example TERPINEOL PURE; 2-(4-methylcyclohex-3-en-1-yl)propan-2-yl acetate, for example TERPINYL ACETATE; 3,7-dimethyloctan-3-ol, for example TETRAHYDRO LINALOOL; oxacyclohexadecan-2-one, for example THIBETOLIDE; 1-(2,2,6-trimethylcyclohexyl)hexan-3-ol, for example TIMBEROL; 2,4-dimethylcyclohex-3-enecarbaldehyde, for example TRICYCLAL; 3-(benzo[d][1,3]dioxol-5-yl)-2-methylpropanal, for example TROPIONAL; (E)-4-methyldec-3-en-5-ol, for example UNDECAVERTOL; 4-hydroxy-3-methoxybenzaldehyde, for example VANILLIN; 2-methoxynaphthalene, for example YARA YARA.

It will be understood by the skilled perfumer that any one of these co-ingredients or any combination of co-ingredients may be employed in admixture with the woody, ambery perfume composition depending upon the particular fragrance effect that is intended to be achieved. Particularly preferred co-ingredients are, however AMBREINE, CEDROXYDE, OSYROL, CEDRENE WASHED, and SCLARENE.

The perfume compositions and fragrance formulations described hereinabove can be used in all the fields of modern perfumery, including technical perfumer and fine perfumery, to positively impart or modify the odour of a consumer product into which said composition is added. Consequently, a consumer product, which is perfumed by a perfume composition or fragrance formulation described herein, form additional aspects of the present invention.

A consumer product as referred to herein is a reference to a product which is expected to deliver at least a perfuming effect to the surface onto which it is applied, such as hair, textiles or home surfaces, or their surroundings, although it can deliver other benefit agents that may be commonly used with perfume compositions or fragrance formulations such as detergents, surfactants, and the like.

Non-limiting examples of suitable consumer products include fine perfume, cologne or after-shave lotion; a fabric care product, such as a liquid or solid detergent, a fabric softener, a fabric refresher, an ironing water, a paper, or a bleach; a body-care product, such as a hair care product (e.g. a shampoo, a colouring preparation or a hair spray), a cosmetic preparation (e.g. a vanishing cream or a deodorant or antiperspirant), or a skin-care product (e.g. a perfumed soap, shower or bath mousse, oil or gel, or a hygiene product); an air care product, such as an air freshener or a "ready to use" powdered air freshener; or a home care product, such as a wipe, a dish detergent or hard-surface detergent.

The proportions in which the woody, ambery perfume composition according to the invention can be incorporated into the various aforementioned consumer products will vary within a wide range of values. These values are dependent on the nature of the consumer product to be perfumed and on the desired organoleptic effect as well as the nature of the co-ingredients in a given perfumery base when the perfume composition according to the invention is mixed with perfumery co-ingredients, carriers, solvents or adjuvants referred to hereinabove.

Typical concentrations will be on the order of 0.1% to 5% by weight, or even more, based on the total weight of the consumer product into which they are incorporated.

Specific examples of consumer products include, but are not limited to baby care, beauty care, fabric & home care, family care, feminine care, health care, such as diapers, bibs, wipes; products for and/or methods relating to treating hair (human, dog, and/or cat), including, bleaching, colouring, dyeing, conditioning, shampooing, styling; deodorants and antiperspirants; personal cleansing; cosmetics; skin care including application of creams, lotions, and other topically applied products for consumer use including fine fragrances; and shaving products, products for and/or methods relating to treating fabrics, hard surfaces and any other surfaces in the area of fabric and home care, including air care including air fresheners and scent delivery systems, car care, dishwashing, fabric conditioning (including softening and/or freshening), laundry detergency, laundry and rinse additive and/or care, hard surface cleaning and/or treatment including floor and toilet bowl cleaners, and other cleaning for consumer or institutional use; products and/or methods relating to bath tissue, facial tissue, paper handkerchiefs, and/or paper towels; tampons and feminine napkins.

As used herein, the term "cleaning and/or treatment composition" is a subset of consumer products that includes, unless otherwise indicated, beauty care, fabric & home care products. Such products include, but are not limited to, products for treating hair (human, dog, and/or cat), including, bleaching, coloring, dyeing, conditioning, shampooing, styling; deodorants and antiperspirants; personal cleansing; cosmetics; skin care including application of creams, lotions, and other topically applied products for consumer use including fine fragrances; and shaving products, products for treating fabrics, hard surfaces and any other surfaces in the area of fabric and home care, including: air care including air fresheners and scent delivery systems, car care, dishwashing, fabric conditioning (including softening and/or freshening), laundry detergency, laundry and rinse additive and/or care, hard surface cleaning and/or treatment including floor and toilet bowl cleaners, granular or powder-form all-purpose or "heavy-duty" washing agents, especially cleaning detergents; liquid, gel or paste-form all-purpose washing agents, especially the so-called heavy-duty liquid types; liquid fine-fabric detergents; hand dishwashing agents or light duty dishwashing agents, especially those of the high-foaming type; machine dishwashing agents, including the various tablet, granular, liquid and rinse-aid types for household and institutional use; liquid cleaning and disinfecting agents, including antibacterial hand-wash types, cleaning bars, mouthwashes, denture cleaners, dentifrice, car or carpet shampoos, bathroom cleaners including toilet bowl cleaners; hair shampoos and hair-rinses; shower gels, fine fragrances and foam baths and metal cleaners; as well as cleaning auxiliaries such as bleach additives and "stain-stick" or pre-treat types, substrate-laden products such as dryer added sheets, dry and wetted wipes and pads, nonwoven substrates, and sponges; as well as sprays and mists all for consumer or/and institutional use. As used herein, the term "fabric and/or hard surface cleaning and/or treatment composition" is a subset of cleaning and treatment compositions that includes, unless otherwise indicated, granular or powder-form all-purpose or "heavy-duty" washing agents, especially cleaning detergents; liquid, gel or paste-form all-purpose washing agents, especially the so-called heavy-duty liquid types; liquid fine-fabric detergents; hand dishwashing agents or light duty dishwashing agents, especially those of the high-foaming type; machine dishwashing agents, including the various tablet, granular, liquid and rinse-aid types for household and institutional use; liquid cleaning and disinfecting agents, including antibacterial hand-wash types, cleaning bars, car or carpet shampoos, bathroom cleaners including toilet bowl cleaners; and metal cleaners, fabric conditioning products including softening and/or freshening that may be in liquid, solid and/or dryer sheet form; as well as cleaning auxiliaries such as bleach additives and "stain-stick" or pre-treat types, substrate-laden products such as dryer added sheets, dry and wetted wipes and pads, nonwoven substrates, and sponges; as well as sprays and mists. All of such products which were applicable may be in standard, concentrated or even highly concentrated form even to the extent that such products may in certain aspect be non-aqueous.

The invention will now be further described and illustrated with reference to the following examples.

Example 1

A series of woody, ambery perfume compositions were prepared by mixing primary and secondary ingredients, tertiary ingredients, and/or solvents or diluents. The resulting composition are reported in Table 1.

The performance results demonstrate that by combining primary and secondary ingredients, as defined hereinabove, it is possible to form compositions that substantially match KARANAL both hedonically and in terms of performance (see Example 3).

In these examples, the sharp, dry, mineral, "cold", sticky dirty sweat, nitrile, green, radiant, fusing, burning odour characteristics of KARANAL are mimicked when (1'R,3S,6'S)-1-(2',2',6'-trimethyl-1'-cyclohexyl)-3-hexanol and (1'S,3S,6'R)-1-(2',2',6'-trimethyl-1'-cyclohexyl)-3-hexanol and their mixtures, and AMBROCENIDE and/or AMBERMAX; and/or AMBER XTREM; are combined with one or more of SPIRAMBRENE, PHARAONE, MYSTICAL and ALDRONE.

TABLE 1

| COMPOSITION OF WOODY, AMBERY COMPOSITION, WITH OPTIONAL INGREDIENTS | A | B | C | D | E | F | G | H | I | J | K | L |
|---|---|---|---|---|---|---|---|---|---|---|---|---|
| NIMBEROL | 40.0 | 16.0 | 20.0 | 16.0 | 16.0 | 10.0 | 10.0 | 10.0 | 10.0 | 70.0 | 70.0 | 40.0 |
| Primary ingredients | | | | | | | | | | | | |
| Primary ingredient Stereoisomers (1) | 36.0 | 14.4 | 18.0 | 14.4 | 14.4 | 9.0 | 9.0 | 9.0 | 9.0 | 63.0 | 63.0 | 36.0 |
| AMBERMAX FROM 10% TEC (2) | 2.0 | 1.5 | 1.4 | 1.5 | 1.5 | | | | | | 2 | |
| AMBROCENIDE CRYST | | | 1.2 | 1.2 | 1.2 | 6.5 | 1.2 | 1.2 | 1.2 | | | |
| AMBROCENIDE FROM 10% DPG (2) | 3.0 | 1.2 | | | | | | | | | | 3 |
| AMBER XTREME | | | | | 1.0 | 2.0 | 2.0 | 2.0 | 2.0 | | | |
| Secondary ingredients | | | | | | | | | | | | |
| Secondary Ingredient Stereoisomers (3) | 4.0 | 1.6 | 2.0 | 1.6 | 1.6 | 1.0 | 1.0 | 1.0 | 1.0 | 7 | 7 | 4 |
| MYSTIKAL FOM 10% TEC (2) | | | | | 0.002 | | 0.003 | 0.002 | 0.002 | | | |
| ALDRONE | | | | | | | | 0.5 | 1.0 | | | |
| SPIRAMBRENE | | | | | | | | | | 20 | | 20 |
| PHARAONE FROM 10% DPG (2) | | | | 0.02 | | | | | | | | |
| Solvents and fillers | | | | | | | | | | | | |
| DIPROPYLENE GLYCOL | 37.0 | 67.8 | 64.8 | 0.18 | | | | | | | 10 | 37 |
| TRIETHYL CITRATE (TEC) | 18.0 | 13.5 | 12.6 | | 13.7 | | 0.027 | 0.018 | 0.018 | 10 | 18 | |
| ISO E SUPER | | | | 81.1 | 66.60 | 81.50 | 86.77 | 86.28 | 85.78 | | | |
| Perfomance | FAIR | FAIR | GOOD − | GOOD | GOOD + | GOOD BUT VERY STRONG | VERY GOOD | VERY GOOD + | EXCELLENT | FAIR | FAIR | FAIR |

(1) Amount of isomer mixture of (1'R,3S,6'S)-1-(2',2',6'-trimethyl-1'-cyclohexyl)-3-hexanol and (1'S,3S,6'R)-1-(2',2',6'-trimethyl-1'-cyclohexyl)-3-hexanol present in the NIMBEROL
(2) Dilution factor taken into account
(3) Amount of the isomer mixture of (1'S,3R,6'R)-1-(2',2',6'-trimethyl-1'-cyclohexyl)-3-hexanol, (1'R,3R,6'S)-1-(2',2',6'-trimethyl-1'-cyclohexyl)-3-hexanol, present in the NIMBEROL

Example 2

In this example, attempts were made to match KARANAL odour characteristics by using only primary ingredients or only secondary ingredients. The results of these comparative reported in Table 2 are not satisfactory. On the other hand, one single ingredient having components in both primary and secondary ingredient categories provides better results, but still below the results obtained in Example 1, where a diversity of ingredients in both categories have been considered.

TABLE 2

| Comparative examples | N | O | P | Q | R | S | T |
|---|---|---|---|---|---|---|---|
| Primary ingredients | | | | | | | |
| NIMBEROL | 25.0 | | | | | | |
| Primary ingredient Stereoisomers (1) | 22.5 | | | | | | |
| AMBERMAX FROM 10% TEC (2) | | 2.0 | | | 1.0 | | |

TABLE 2-continued

| | Comparative examples | | | | | | | |
|---|---|---|---|---|---|---|---|---|
| AMBROCENIDE CRYST | | | 2.0 | | 1.0 | | | |
| AMBROCENIDE FROM 10% DPG (2) | | | | 2.0 | | | | |
| AMBER XTREM | | | | | 1.0 | | | |
| Secondary ingredients | | | | | | | | |
| Primary ingredient Stereoisomers (3) | 2.5 | | | | | | | |
| MYSTIKAL FOM 10% TEC (2) | | | | | | 0.002 | | |
| ALDRONE | | | | | | | 1.0 | |
| Solvents and fillers | | | | | | | | |
| ISO E SUPER | 75.0 | 98.0 | 98.0 | 98.0 | 97.0 | 99.998 | 99.0 | |
| Match vs. KARANAL | FAIR | POOR | POOR | POOR | POOR | POOR | POOR | |
| | U | V | W | X | Y | Z | AA | AB |
| Secondary ingredients | | | | | | | | |
| MYSTIKAL FOM 10% TEC (2) | 0.002 | | 0.002 | | | | | |
| ALDRONE | 1.0 | | | 1.0 | | | | |
| SPIRAMBRENE | 19.0 | | | | | | | |
| PHARAONE FROM 10% DPG (2) | | 0.020 | | | | | | |
| OKOUMAL | | | 10.0 | | | | | |
| AMBER CORE | | | | 15.0 | | | | |
| TRISAMBER | | | | | 15.0 | | | |
| YSAMBER | | | | | | 15.0 | | |
| TRIMOFIX O | | | | | | | | 10.0 |
| Solvents and fillers | | | | | | | | |
| ISO E SUPER | 79.998 | 99.98 | 89.998 | 84.0 | 85.0 | 85.0 | 90.0 | 100.0 |
| Match vs. KARANAL | POOR | POOR | POOR | POOR | POOR | POOR | POOR | POOR |

(1) Amount of isomer mixture of (1'R,3S,6'S)-1-(2',2',6'-trimethyl-1'-cyclohexyl)-3-hexanol and (1'S,3S,6'R)-1-(2',2',6'-trimethyl-1'-cyclohexyl)-3-hexanol present in the NIMBEROL
(2) Dilution factor taken into account
(3) Amount of the isomer mixture of (1'S,3R,6'R)-1-(2',2',6'-trimethyl-1'-cyclohexyl)-3-hexanol, (1'R,3R,6'S)-1-(2',2',6'-trimethyl-1'-cyclohexyl)-3-hexanol, present in the NIMBEROL

Example 3

The compositions of Example 1 were evaluated on blotter and on skin. Both odour characteristics and performance were compared with KARANAL at application time (t=0), after 2 hours and after 4 hours on both substrates. The results are reported in Table 1, where the attribute were ranked from FAIR (reminiscent of KARANAL, but still not optimized for performance at all stages of the assessment, either on the hedonic side or on the performance side) to EXCELLENT (matching all attributes of KARANAL at all stages of the assessment, either on the hedonic side or on the performance side.

The invention claimed is:

1. A woody, ambery perfume composition, free or substantially free of 2-(2,4-dimethylcyclohex-3-en-1-yl)-5-methyl-5-(1-methylpropyl)-1,3-dioxane and comprising a mixture of at least three perfume ingredients selected from:

a) at least one primary perfume ingredient selected from the group consisting of (1'R,3S,6'S)-1-(2',2',6'-trimethyl-1'-cyclohexyl)-3-hexanol, (1'S,3S,6'R)-1-(2',2',6'-trimethyl-1'-cyclohexyl)-3-hexanol or any mixture thereof; an isomer or mixture of isomers of octahydro-2,2,5,8,8,9a-hexamethyl-4H-4a,9-methanoazuleno[5,6-d]-1,3-dioxole; an isomer or mixture of isomers of 2-(TETRAMETHYLTRICYCLO[6.2.1.0]UNDEC-4/5-EN-5-YL)PROPANOL having the formula

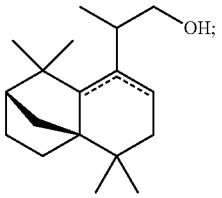

and an isomer or mixture of isomers of DECAHYDRO-2,2,6,6,7,8,8-HEPTAMETHYL INDENOFURAN; AND b) at least one secondary perfume ingredient selected from the group consisting of (Z)-4,11,11-trimethyl-8-methylenebicyclo[7.2.0]undec-4-ene; 3a,6,6,9a-tetramethyl-2,4,5,5a,7,8,9,9b-octahydro-1H-benzo[e][1]benzofuran; (ethoxymethoxy)cyclododecane; 6-(sec-butyl)quinoline; (1R,6S,8aS)-6-methoxy-1,4,4,6-tetramethyloctahydro-1H-5,8a-methanoazulene; 2-(tert-pentyl)cyclohexyl acetate; 2-(2-(3,3,5-trimethylcyclohexyl)acetyl)cyclopentanone; (1aS,2aR,3R,5aS,7R,7aR)-octahydro-3,6,6,7a-tetramethyl-2H-2a,7-methanozuleno 5,6-b oxirene; 3a,6,6,9a-tetramethyldodecahydronaphtho[2,1-b]furan; 2,4a,5,8a-tetramethyl-1,2,3,4,4a,7,8,8a-octahydronaphthalen-1-yl formate; 1-(1,2,8,8-tetramethyl-1,2,3,4,5,6,7,8-octahydronaphthalen-2-yl)ethanone; 2,2,7,7-tetramethyltricyclo[6.2.1.01,6] undecanethan-5-one; (Z)-3,4,5,6,6-pentamethylhept-3-en-2-one; 3,4,5,6,6-pentamethylheptan-2-ol; 1-((1S,8aS)-1,4,4,6-tetramethyl-2,3,3a,4,5,8-hexahydro-1H-5,8a-methanoazulen-7-yl)ethanone; 2,4-dimethyl-2-(5,5,8,8-tetramethyl-5,6,7,8-tetrahydronaphthalen-2-yl)-1,3-dioxolane; 2',2',3,7,7-pentamethylspiro[bicyclo[4.1.0]heptane-2,5'-[1, 3]dioxane]; 1-((2E,5Z,9Z)-2,7,8-trimethylcyclododeca-2,5,9-trien-1-yl)ethanone; 1-((1S,8aS)-1,4,4,6-tetramethyl-2,3,3a,4,5,8-hexahydro-1H-5,8a-methanoazulen-7-yl)ethanone; 2-methyl-4-(5,6,6-trimethylbicyclo[2.2.1]hept-2-yl-cyclohexanone; 1-((2-(tert-butyl)cyclohexyl)oxy)butan-2-ol; 3,8,8,11a-tetramethyldodecahydro-1H-3,5a-epoxynaphtho[2,1-c]oxepine; 3a,6,6,9a-tetramethyldodecahydronaphtho[2,1-b]furan; (1R,2S,4R)-2'-isopropyl-1,7,7-trimethylspiro[bicyclo[2.2.1]heptane-2,4'-[1,3]dioxane]; 2-(sec-butyl)-1-vinylcyclohexyl acetate; 4-(1-ethoxyvinyl)-3,3,5,5-tetramethylcyclohexanone; 2-(sec-butyl)-1-methylcyclohexyl acetate; 2-methylundecanoic acid; 2-cyclohexylhepta-1,6-dien-3-one; decahydro-2,6,6,7,8,8-hexamethyl-2H-indeno[4,5-b]furan; and hexahydro-1',1',5',5'-tetramethyl-spiro(1,3-dioxolane-2,8'(5'H)-(2H-2,4a)methanonaphthalene), wherein (1'R,3S,6'S)-1-(2',2',6'-trimethyl-1'-cyclohexyl)-3-hexanol, (1'S,3S,6'R)-1-(2',2',6'-trimethyl-1'-cyclohexyl)-3-hexanol or any mixture thereof is present in an amount of 4.5 to 90 wt % based on the total weight of said composition, wherein the composition comprises an isomer or mixture of isomers of octahydro-2,2,5,8,8,9a-hexamethyl-4H-4a,9-methanoazuleno[5,6-d]-1,3-dioxole and/or an isomer or mixture of isomers of 2-(tetramethyltricyclo[6.2.1.0]undec-4/5-en-5-yl)propanol and/or an isomer or mixture of isomers of decahydro-2,2,6,6,7,8,8-heptamethyl indenofuran; and wherein the composition comprises one or more of 2',2',3,7,7-pentamethylspiro[bicyclo[4.1.0]heptane-2,5'-[1,3]dioxane], 2-cyclohexylhepta-1,6-dien-3-one, 2-methylundecanoic acid, and 2-methyl-4-(5,6,6-trimethylbicyclo[2.2.1]hept-2-yl-cyclohexanone.

2. A perfume composition according to claim 1, additionally comprising 1-(2,3,8,8-tetramethyl-1,2,3,4,5,6,7,8-octahydronaphthalen-2-yl)ethanone as a tertiary perfume ingredient.

3. A fragrance formulation comprising a perfume composition according to claim 2 and at least one additional perfume co-ingredient.

4. A perfumed article selected from a fine perfume, a fabric care product, home care product, personal care product or air care product that contains a woody, ambery perfume composition according to claim 2.

5. A method of imparting an odour accord reminiscent of 2-(2,4-dimethylcyclohex-3-en-1-yl)-5-methyl-5-(1-methylpropyl)-1,3-dioxane to a fragrance formulation, said method comprising the step of incorporating into said fragrance formulation, which is free of 2-(2,4-dimethylcyclohex-3-en-1-yl)-5-methyl-5-(1-methylpropyl)-1,3-dioxane, a woody, ambery perfume composition according to claim 2.

6. A fragrance formulation comprising a perfume composition according to claim 1 and at least one additional perfume co-ingredient.

7. A perfumed article selected from a fine perfume, a fabric care product, home care product, personal care product or air care product that contains a fragrance formulation according to claim 6.

8. A perfumed article selected from a fine perfume, a fabric care product, home care product, personal care product or air care product that contains a woody, ambery perfume composition according to claim 1.

9. A method of imparting an odour accord reminiscent of 2-(2,4-dimethylcyclohex-3-en-1-yl)-5-methyl-5-(1-methylpropyl)-1,3-dioxane to a fragrance formulation, said method comprising the step of incorporating into said fragrance formulation, which is free of 2-(2,4-dimethylcyclohex-3-en-1-yl)-5-methyl-5-(1-methylpropyl)-1,3-dioxane, a woody, ambery perfume composition according to claim 1.

10. A perfume composition according to claim 1, wherein the isomer or mixture of isomers of octahydro-2,2,5,8,8,9a-hexamethyl-4H-4a,9-methanoazuleno[5,6-d]-1,3-dioxole includes (4aR,5R,7aS,9R)-octahydro-2,2,5,8,8,9a-hexamethyl-4H-4a,9-methanoazuleno[5,6-d]-1,3-dioxole.

* * * * *